US009262875B1

(12) United States Patent
Chen

(10) Patent No.: US 9,262,875 B1
(45) Date of Patent: Feb. 16, 2016

(54) LOCK STRUCTURE OF DUAL PROTECTION

(71) Applicant: Te-Yu Chen, Pingtung (TW)

(72) Inventor: Te-Yu Chen, Pingtung (TW)

( * ) Notice: Subject to any disclaimer, the term of this patent is extended or adjusted under 35 U.S.C. 154(b) by 0 days.

(21) Appl. No.: 14/686,796

(22) Filed: Apr. 15, 2015

(51) Int. Cl.
*E05B 47/06* (2006.01)
*G07C 9/00* (2006.01)
*E05B 63/08* (2006.01)

(52) U.S. Cl.
CPC ..... *G07C 9/00007* (2013.01); *E05B 63/08* (2013.01); *E05B 47/0603* (2013.01); *E05B 47/0673* (2013.01); *Y10T 70/5226* (2015.04); *Y10T 70/7062* (2015.04); *Y10T 70/7102* (2015.04); *Y10T 70/713* (2015.04); *Y10T 70/7107* (2015.04)

(58) Field of Classification Search
CPC ..... G07C 9/00007; E05B 63/08; E05B 47/06; E05B 47/0603; E05B 47/0607; E05B 47/0665; E05B 47/0669; E05B 47/0673; Y10T 70/7062; Y10T 70/7102; Y10T 70/7107; Y10T 70/713; Y10T 70/7136; Y10T 70/5226
USPC ..... 70/107, 277, 278.7, 279.1, 283, 283.1
See application file for complete search history.

(56) References Cited

U.S. PATENT DOCUMENTS 5,987,945 A * 11/1999 Ruano Aramburu ..... E05B 47/0692 70/107
2004/0099026 A1* 5/2004 Nunez ..... E05B 47/0673 70/283
2005/0199026 A1* 9/2005 Geringer ..... E05B 47/0676 70/283
2006/0112747 A1* 6/2006 Moon ..... E05B 47/0673 70/283
2010/0263418 A1* 10/2010 Moon ..... E05B 55/00 70/107
2013/0192319 A1* 8/2013 Lambrou ..... E05B 47/0673 70/283
2014/0008920 A1* 1/2014 Bartos ..... E05B 47/0004 292/138

* cited by examiner

*Primary Examiner* — Lloyd Gall
(74) *Attorney, Agent, or Firm* — Leong C. Lei

(57) ABSTRACT

A lock structure of dual protection includes a lock core rotating shaft, swing rod, push rod, brake shoe and handle rotating shaft coupled pivotally to a door handle configure on a lock, wherein a first latch element is configured above the swing rod, and a second latch element at one side of the handle rotating shaft, allowing the first latch element and second latch element to be in respective connection with indoor and outdoor card readers through a control circuit. Whereby, the lock must be unlocked by swiping an access card outdoors or indoors while being locked, and a user is allowed to turn a door handle to unlock the lock indoors or outdoors by means of the motion of the first latch element of second latch element subjected to or released from magnetic suction while the access card is swiped so that the dual protection can be achieved.

4 Claims, 5 Drawing Sheets

LOCK STRUCTURE OF DUAL PROTECTION

TECHNICAL FIELD OF THE INVENTION

The present invention relates to a lock structure of dual protection, and more particularly to a lock structure of dual protection capable of being unlocked from the inside or outside of a door by swiping an access card so as to achieve dual protection.

DESCRIPTION OF THE PRIOR ART

General door locks are locked from the inside of a room by turning the rotating shafts thereof a several times and from the outside by using a key. Thanks to science and technology, card readers are installed in hotels, important venues or even homes, entering which only access cards are needed, but such kinds of electronic locks only allow persons to open doors with the cards from the outside without the ability to form the dual protection for entrance guard when going out, and cause the trouble to unlock the locks upon power failure.

SUMMARY OF THE INVENTION

To improve a lock structure, allow a door to be opened from both outside and inside by swiping an access card, and further to achieve dual protection, the present invention is proposed.

The main object of the present invention is to provide a lock structure of dual protection, allowing the lock to be unlocked from the outside or inside of a door by swiping access card so as to achieve dual protection, and further to allow the lock to be of high safety.

To achieve the object mentioned above, the present invention proposes a lock structure of dual protection, including a lock core rotating shaft, swing rod, push rod, brake shoe and handle rotating shaft coupled pivotally to a door handle configured on a lock, wherein a first latch element is configured above the swing rod, and a second latch element at one side of the handle rotating shaft, allowing the first latch element and second latch element to be in respective connection with indoor and outdoor card readers through a control circuit. Whereby, the lock must be unlocked by swiping an access card outside or inside a door when being locked, and a user is allowed to turn a door handle to unlock the lock inside or outside the door by means of the motion of the first latch element of second latch element subjected to or released from magnetic suction while the access card is swiped so that the dual protection can be achieved. Furthermore, security personnel may use a key to unlock the lock from the outside of the lock core rotating shaft upon power failure, allowing the lock to have more safety.

According to the lock structure of dual protection of the present invention, the brake shoe is configured with a rectangular slide hole put around a shaft portion of the push rod, allowing the curved up-and-down movement of the brake shoe; security personnel may use a key to unlock the lock from the outside of the lock core rotating shaft, causing the brake shoe to be slid downward through the slide hole to prop against the swing rod, thereby positioning the swing rod to stop propping against a lock tongue, and thus unlocking the lock by turning the door handle.

According to the lock structure of dual protection of the present invention, the first latch element and second latch element respectively are a solenoid valve.

In the lock structure of dual protection mentioned above, one end of the shaft center of the first latch element is coupled pivotally to a block sheet after being passed through a spring, allowing one end of the block sheet to be positioned at a positioning shaft configured on the lock, thereby driving the block sheet to swing when the first latch element is subjected to or released from magnetic suction to allow another end of the block sheet to prop against or separate from the push rod.

In the lock structure of dual protection mentioned above, the second latch element is coupled pivotally to a button bar after being passed through a spring, thereby driving the button bar to move levelly when the second latch element is subjected to or released from magnetic suction to buckle the handle rotating shaft.

Furthermore, the handle rotating shaft of the lock structure of dual protection mentioned above is configured with a notch, facilitating the buckling the button bar of the second latch element.

DETAILED DESCRIPTION OF THE PREFERRED EMBODIMENTS

Figure 1:
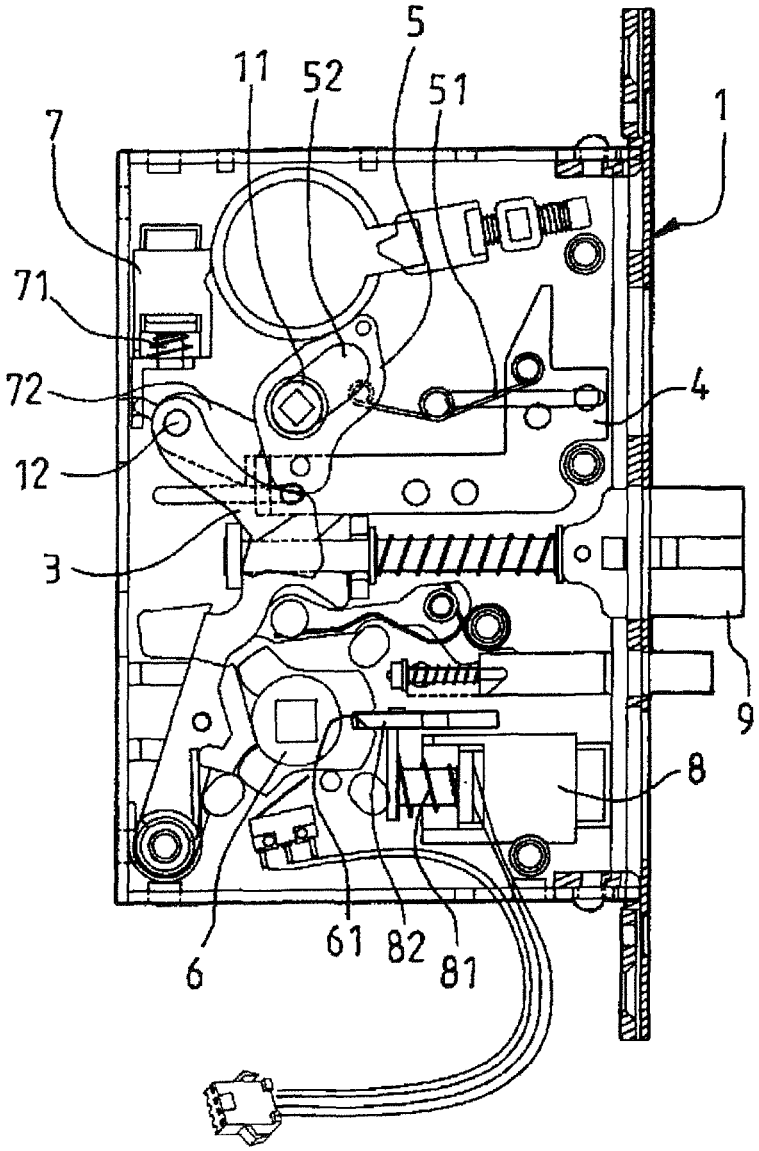
FIG. 1 is a schematic view of a lock structure of the present invention.
Figure 2:
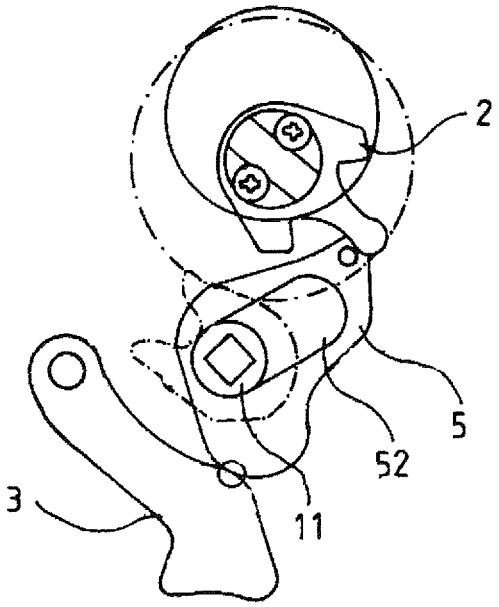
FIG. 2 is a schematically perspective view of a brake shoe structure of the present invention.

Referring to FIGS. 1 and 2, which respectively are a schematic view of a lock structure of the present invention and a schematically perspective view of a brake shoe structure thereof, a lock 1 includes a lock core rotating shaft 2, swing rod 3, push rod 4, brake shoe 5 and handle rotating shaft 6 coupled pivotally to a handle, where a first latch element 7 is configured above the swing rod 3 and a second latch element 8 at one side of the handle rotating shaft 6 with a notch 61, the first latch element 7 and second latch element 8 in respective connection with the card readers inside and outside a door through a control circuit.

The brake shoe 5 is coupled to a push rod 4 through an elastic element 51. Furthermore, a rectangular slide hole 52 is configured on the brake shoe 5 and put around a shaft portion 11 configured on the lock 1, allowing the brake shoe 5 to be moved up and down.

The first latch element 7 is a solenoid valve, the shaft center of which is passed through a spring 71 and the end of which is pivotally coupled to a block sheet 72 which is fixed to a positioning shaft 12 configured on the lock 1 at one end thereof, thereby, the first latch element 7 can drive the block sheet 72 to swing when subjected to or released from magnetic suction. Furthermore, the second latch element 8 is also a solenoid, the shaft center of which is passed through a spring and coupled pivotally to a button bar 82, and the second latch element 8, thereby, can drive the button bar 82 to move levelly when subjected to or released from magnetic suction.

Whereby, the locked lock 1 must be unlocked by swiping an access card outside or inside a door, and the lock can be unlocked by turning a door handle from the outside or inside by means of the motion of the first latch element 7 or second latch element 8 subjected to or released from magnetic suction when the card is swiped so as to achieve the dual protection. Furthermore, security personnel may open the door with a key from the outside of the lock core rotating shaft 2 upon electricity failure, allowing the lock to be more safety.

Figure 3:
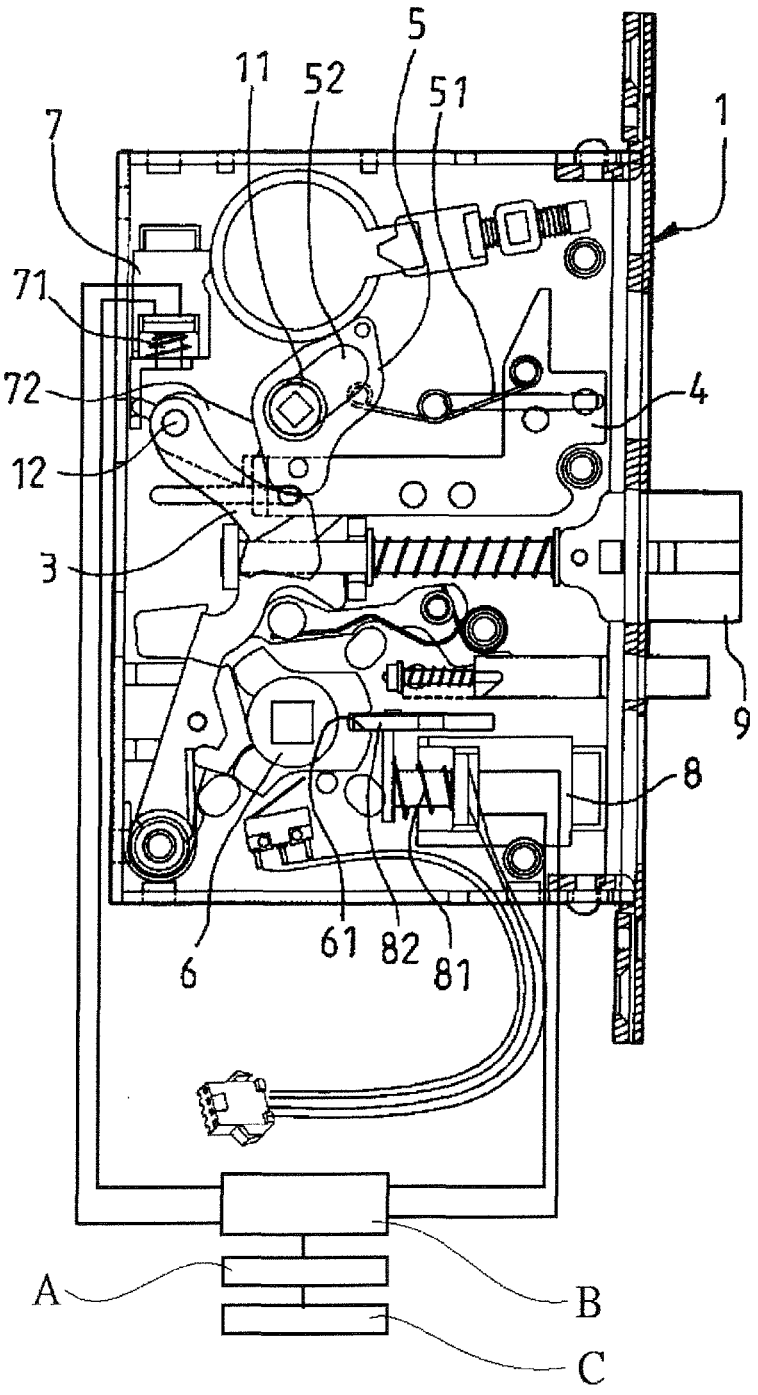
FIG. 3 is a schematic view of the lock in connection with card readers according to the present invention.

Referring to FIG. 3, which is a schematic view of the lock of the present invention in connection with a card reader, the first latch element 7 and second latch element 8, as the figure shows, are in respective connection with a control circuit A which is respectively in electric connection with an indoor card reader B and outdoor card reader C after the present invention is assembled. Whereby, the motion of the first latch element 7 or second latch element 8 subjected to or released from magnetic suction is generated after the card is read by the indoor card reader B or outdoor card reader C so that a user can turn the door handle to unlock the lock 1 from the inside or outside, and the dual protection can thus be achieved.

Referring to FIG. 1 again, the first latch element 7 is in an electric conduction state when the present invention is locked, one end of the block sheet 72 is pulled upward due to the magnetic suction of the solenoid valve, and another end thereof are thus forced to prop against the push rod 4, while the second latch element 8 is in a power-off state, allowing the button bar 82 to be pushed out through the spring 81 due to the release of the solenoid valve, and the button bar 82 thus to be engaged with the notch 61 of the handle rotating shaft 6 to buckle the handle. As a result, a lock tongue 9 of the lock 1 is stretched out so that the indoor and outdoor sides of the lock 1 are both locked, and thus, the door cannot be opened with the handle but the lock needs to be unlocked first by swiping the card.

Figure 4:
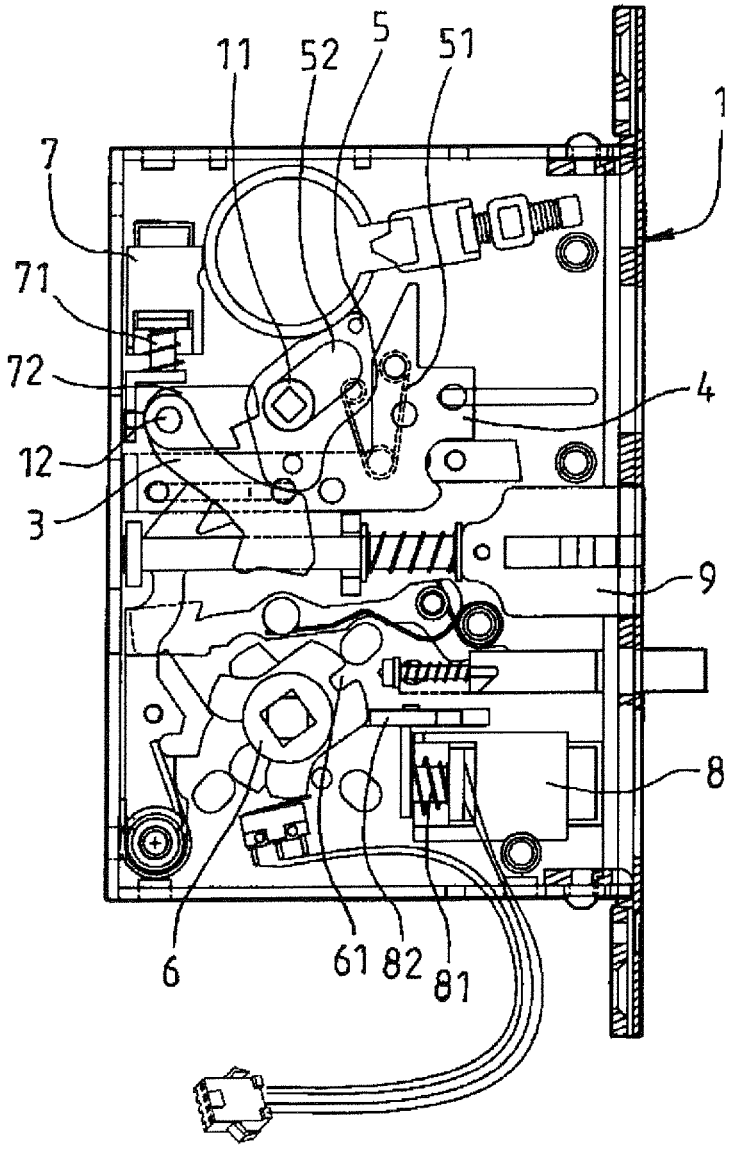
FIG. 4 is a schematic view of the lock structure in the state of being unlocked by swiping an access card outside a door according to the present invention.

Referring to FIG. 4, which is a schematic view of the lock unlocked from the outside by swiping an access card according to the present invention and seeing also FIG. 3, an access card is read by the outdoor card reader C when the lock 1 of the present invention is unlocked from the outside; the card is interpreted by the control circuit A after being read, causing the first latch element 7 to be in a power-off state; one end of the block sheet 72 is pushed downward due to the release of the solenoid valve, and another end thereof thus stops propping against the push rod 4 so that the push rod 4 can then slide freely, while the second latch element 8 is in an electric conduction state, allowing the button bar 82 to be released from the notch 61 of the handle rotating shaft 6 due to the magnetic suction of the solenoid so that a user can turn an outside door handle to pull the lock tongue 9 to move to unlock the lock 1.

Figure 5:
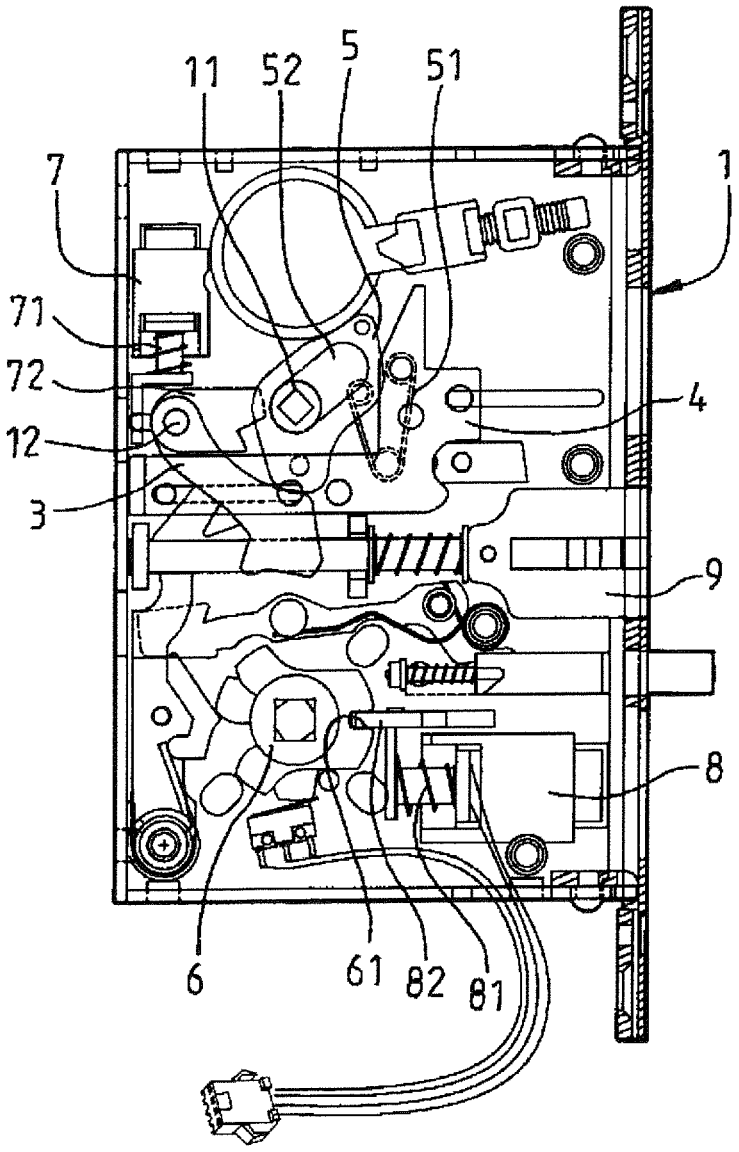
FIG. 5 is a schematic view of the lock structure in the state of being unlocked by swiping an access card inside a door according to the present invention.

Next, referring to FIG. 5, which is a schematic view of the lock unlocked from the inside by swiping an access card according to the present invention, an access card is read by the indoor card reader B when the lock 1 of the present invention is unlocked from the inside; the card is interpreted by the control circuit A after being read, causing the first latch element 7 to be in a power-off state; one end of the block sheet 72 is pushed downward due to the release of the solenoid valve, and another end thereof thus stops propping against the push rod 4 so that the push rod 4 can then slide freely, while the second latch element 8 is in a power-off state, allowing the button bar 82 to be pushed out through the spring 81 due to the release of the solenoid valve to cause the button bar 82 to be engaged with the notch 61 of the handle rotating shaft 6 so that a user can turn the lock core rotating shaft 2 from the inside to retreat the lock tongue 9 to unlock the lock 1.

Finally, referring to FIGS. 2 and 5 again, upon power failure, both the first latch element 7 and second latch element 8 are in a power-off state, causing the end of the block sheet 72 of the first latch element 7 to stop propping against the push rod 4 due to the release of the solenoid valve, and button bar 82 to be engaged with the notch 61 of the handle rotating shaft 6; security personnel may insert a key into the lock core rotating shaft 2 from the outside to allow the brake shoe 5 to slide downward along the shaft portion 11 through the slide hole 52 to press against the swing rod 3 so that the swing rod 3 is not propped against the lock tongue 9 due to the positioning thereof so that a user can turn the handle to unlock the lock 1.

I claim:

1. A lock structure of dual protection, comprising a lock core rotating shaft, swing rod, push rod, brake shoe and handle rotating shaft coupled pivotally to a door handle configured on a lock, characterized in that:

a first latch element is configured above said swing rod, and a second latch element at one side of said handle rotating shaft, allowing said first latch element and second latch element to be in respective connection with indoor and outdoor card readers through a control circuit; said brake shoe is coupled to a push rod configured with a rectangular slide hole through an elastic element, said slide hole being put around a shaft portion configured on said lock, allowing said brake shoe to be moved up and down, thereby forming a motion of said first latch element or second latch element subject to or released from magnetic suction by swiping an access card indoors or outdoors when said lock is locked, and further allowing said first latch element to be propped against or separated from said push rod, and said second latch element to be engaged with or released from said handle rotating shaft so that a user may turn a door handle to open a door indoors or outdoors, and dual protection is thus achieved; security personnel may use a key to unlock said lock from the outside of said lock core rotating shaft upon power failure, allowing said lock to be more safety.

2. The structure according to claim 1, wherein said first latch element is a solenoid valve, an end thereof is coupled pivotally to a block sheet after a shaft center thereof is passed through a spring, allowing one end of said block sheet to be fixed to a positioning shaft configured on said lock, thereby driving said block sheet to swing to prop against or separate from said push rod when said first solenoid element is subjected to or released from magnetic suction.

3. The structure according to claim 1, wherein said second latch element is a solenoid valve, a shaft center is coupled pivotally to a button bar after being passed through a spring, thereby driving said button bar to move levelly to buckle or release said handle rotating shaft when said second latch element is subjected to or released from magnetic suction.

4. The structure according to claim 1, wherein said handle rotating shaft is configured with a notch for facilitating a button bar to buckle said handle rotating shaft.

* * * * *